US006951477B2

(12) United States Patent
Tondreault et al.

(10) Patent No.: US 6,951,477 B2
(45) Date of Patent: Oct. 4, 2005

(54) ELECTRONIC CONNECTOR FOR A CABLE

(75) Inventors: Robert J. Tondreault, Costa Mesa, CA (US); James F. DePriest, Costa Mesa, CA (US)

(73) Assignee: Rapid Conn, Inc., Lake Forest, CA (US)

( * ) Notice: Subject to any disclaimer, the term of this patent is extended or adjusted under 35 U.S.C. 154(b) by 0 days.

(21) Appl. No.: 10/624,620

(22) Filed: Jul. 22, 2003

(65) Prior Publication Data

US 2004/0127078 A1 Jul. 1, 2004

Related U.S. Application Data

(60) Provisional application No. 60/397,722, filed on Jul. 22, 2002.

(51) Int. Cl.[7] ..... H01R 9/07
(52) U.S. Cl. ..... 439/497; 439/610
(58) Field of Search ..... 439/497, 498, 439/499, 607–610, 404, 405, 579

(56) References Cited

U.S. PATENT DOCUMENTS

| | | | | | |
|---|---|---|---|---|---|
| 4,083,615 | A | * | 4/1978 | Volinskie | 439/402 |
| 4,234,759 | A | | 11/1980 | Harlow | 174/104 |
| 4,596,428 | A | | 6/1986 | Tengler | 439/497 |
| 5,163,849 | A | * | 11/1992 | Fogg et al. | 439/497 |
| 5,190,473 | A | * | 3/1993 | Mroczkowski et al. | 439/580 |
| 5,208,426 | A | | 5/1993 | Kennedy et al. | 174/36 |
| 5,267,874 | A | * | 12/1993 | Koegel et al. | 439/497 |
| 5,267,875 | A | * | 12/1993 | Koegel et al. | 439/497 |
| 5,387,124 | A | * | 2/1995 | Shinohara et al. | 439/497 |
| 5,416,268 | A | | 5/1995 | Ellis | 174/36 |
| 5,823,825 | A | * | 10/1998 | Murphy | 439/610 |
| 5,872,334 | A | | 2/1999 | Trazyik | 174/36 |
| 6,331,122 | B1 | | 12/2001 | Wu | 439/567 |
| 6,402,552 | B1 | | 6/2002 | Wagner | 439/606 |
| 6,435,892 | B1 | | 8/2002 | Billman | 439/260 |
| 6,444,902 | B1 | | 9/2002 | Tsao et al. | 174/36 |
| 6,489,563 | B1 | | 12/2002 | Zhao et al. | 174/88 C |
| 6,551,129 | B2 | * | 4/2003 | Kato | 439/497 |
| 6,565,383 | B1 | | 5/2003 | Wu | 439/567 |
| 6,623,299 | B1 | | 9/2003 | Liu | 439/604 |
| 6,630,624 | B2 | | 10/2003 | Tsao et al. | 174/36 |
| 6,653,569 | B1 | | 11/2003 | Sung | 174/88 R |
| 2003/0203680 | A1 | | 10/2003 | Boulros et al. | |

* cited by examiner

*Primary Examiner*—Hien Vu
(74) *Attorney, Agent, or Firm*—Baker & Daniels LLP

(57) ABSTRACT

The present invention relates to an electronic connector for a cable.

36 Claims, 6 Drawing Sheets

ELECTRONIC CONNECTOR FOR A CABLE

This application claims the benefit of U.S. Provisional Application Ser. No. 60/397,722, filed Jul. 22, 2002, which is expressly incorporated by reference herein.

BACKGROUND AND SUMMARY OF THE INVENTION

The present invention relates to an electronic connector for a cable. More particularly, the present invention relates to an electronic connector having advanced cable termination and grounding features to provide a high-speed I/O interface for coupling the cable to an electronic device.

A standard (Serial ATA—www.serialata.org) has been developed that defines a new, high-speed I/O interface for the computer industry. The Serial ATA specification, among other things, defines the connector mating interface(s) but does not specify the termination methodology. The specification entitled "Serial ATA: High Speed Serialized AT Attachment", Revision 1.0, dated Aug. 29, 2001, is incorporated herein by reference. The present invention relates to an improved methodology for terminating a connector to a specified cable, or other similar cable.

According to an illustrated embodiment of the present invention, an electronic connector apparatus is provided for a cable having a plurality of signal conductors and a ground. The apparatus comprises an insulative body including a plurality of contact-receiving openings formed therein, a conductive strip coupled to an end portion of the cable in contact with the ground of the cable, and a plurality of contacts located in the plurality of contact-receiving openings of the body. The plurality of contacts include a plurality of signal contacts coupled to the signal conductors of the cable, and at least one ground contact coupled to the conductive strip to provide a ground connection between the cable ground and the at least one ground contact through the conductive strip.

In one illustrated embodiment, the at least one ground contact is a separate piece from to the conductive strip. In another illustrated embodiment, the at least one ground contact is formed integrally with the conductive strip.

Also according to the present invention, an electronic connector apparatus is provided for a cable having a plurality of signal conductors and a ground. The apparatus comprises an insulative body including a plurality of contact-receiving openings formed therein, and a contact array including a carrier strip and a plurality of contacts coupled to the carrier strip. The plurality of contacts are located in the plurality of contact-receiving openings of the body. Selected ones of the plurality of contacts are coupled to the signal conductors of the cable. The carrier strip is coupled to an end portion of the cable in contact with the ground of the cable to provide a ground connection between the cable ground and at least one of the plurality of contacts.

In an illustrated embodiment, the carrier strip includes at least one retention section that is configured to pierce the end portion of the cable to couple the carrier strip and the contact array to the cable. In one illustrated embodiment, the retention section is electrically coupled to a ground shield located within the cable.

In another illustrated embodiment, at least one end cap is coupled to the body to prevent plastic from entering a mating area of the body during an overmolding process. The at least one end cap illustratively includes at least one spring arm to couple the at least one end cap to the body.

In yet another illustrated embodiment, the contact array includes a plurality of couplers configured to couple the selected contacts to the signal conductors of the cable electrically, without the use of solder. Illustratively, the plurality of couplers are insulation displacement contact sections.

In another illustrated embodiment, the cable ground includes at least one drain wire extending from the end portion of the cable. The carrier strip is coupled to the end portion of the cable in contact with the at least one drain wire to provide a ground connection between the at least one drain wire and at least one of the plurality of contacts.

Also according to the present invention, a method is provided for coupling an electrical connector to a cable having a plurality of signal conductors and a ground. The method comprises providing an insulative body including a plurality of contact-receiving openings formed therein, providing a contact array including a carrier strip and a plurality of contacts, the carrier strip being used to support the plurality of contacts during a forming process, inserting the plurality of contacts into the contact-receiving openings of the body, coupling the carrier strip to an end portion of the cable, and separating selected ones of the plurality of contacts from the carrier strip.

In an illustrated embodiment, method further comprises coupling selected ones of the plurality of contacts to the signal conductors of the cable. The illustrated method further comprises coupling the carrier strip to the ground of the cable to provide a ground connection between cable ground and at least one of the plurality of contacts.

In another illustrated embodiment, the method further comprises attaching at least one end cap to the body to prevent plastic from entering a mating area of the body, and overmolding portions of the body, the carrier, and the cable.

Additional features of the invention will become apparent to those skilled in the art upon consideration of the following detailed description of illustrated embodiments exemplifying the best mode of carrying out the invention as presently perceived.

BRIEF DESCRIPTION OF THE DRAWINGS

The detailed description particularly refers to accompanying figures to which.

DETAILED DESCRIPTION OF THE DRAWINGS

Figure 2:
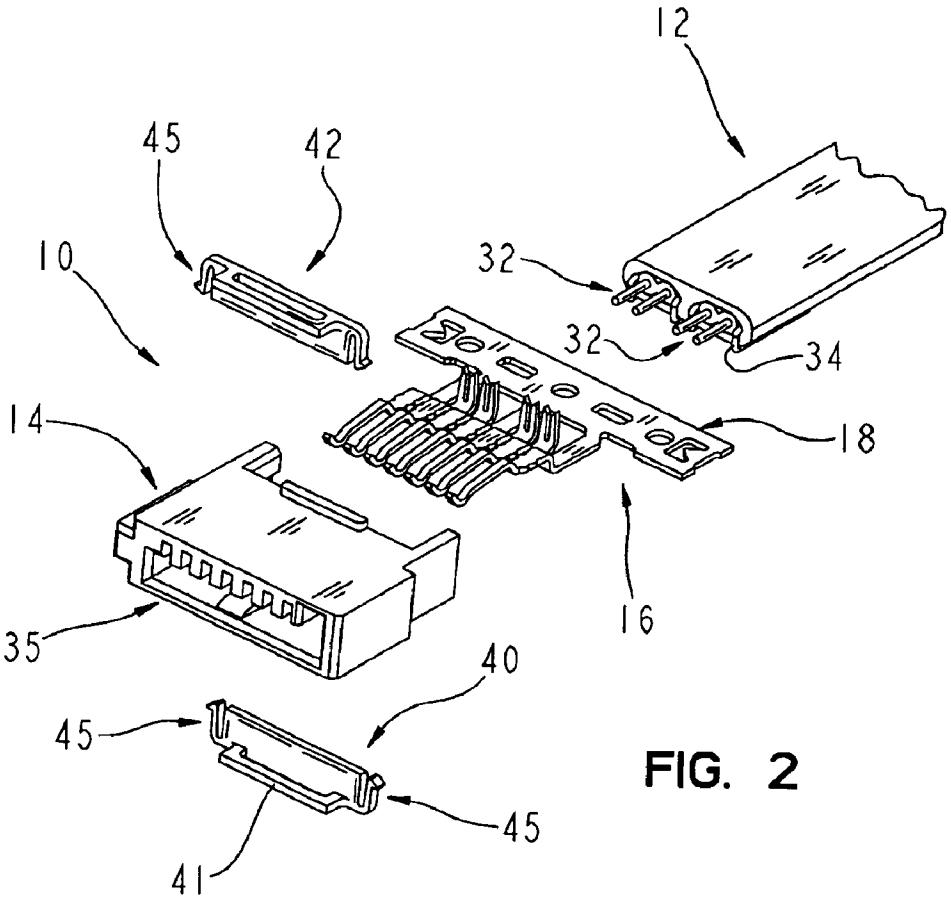
FIG. 2 is an exploded perspective view of the cable and electronic connector of FIG. 1.
Figure 1:
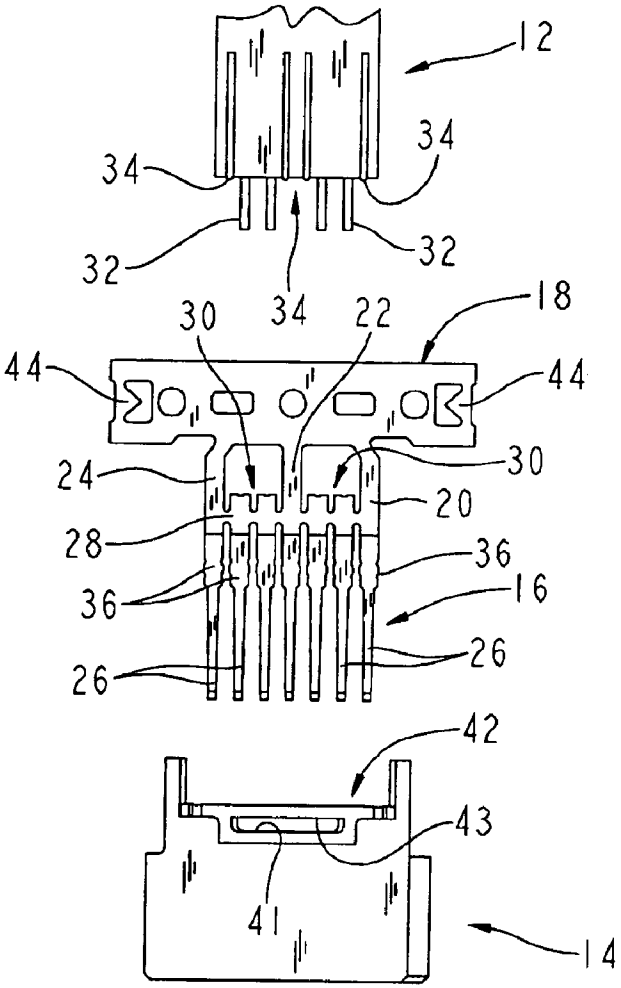
FIG. 1 is an exploded top plan view of a cable and an electronic connector of the present invention.
Figure 3:
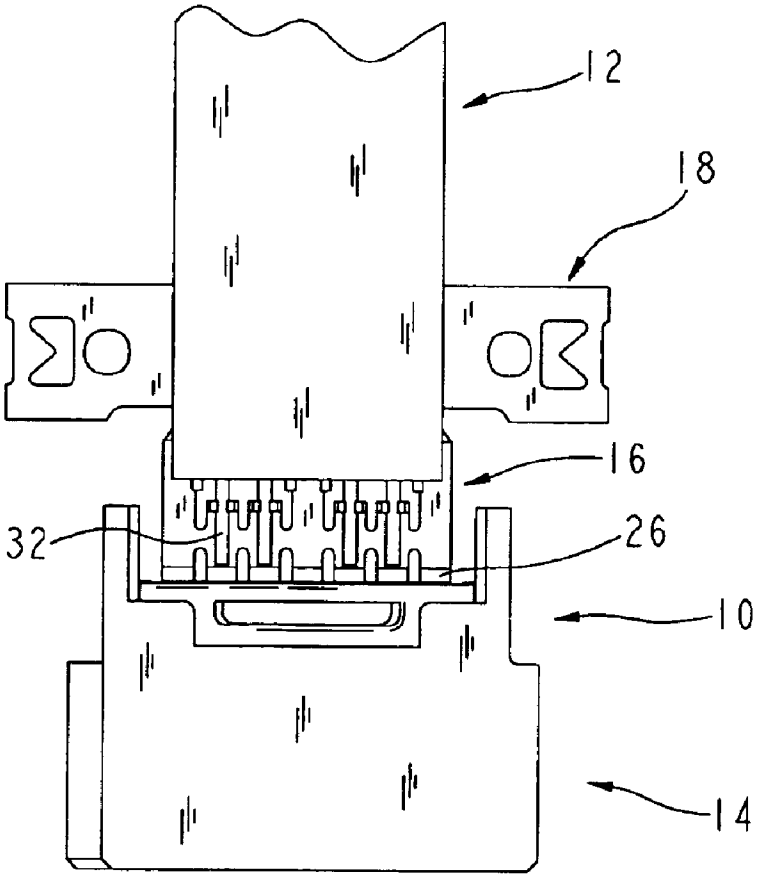
FIG. 3 is a top plan view similar to FIG. 1 illustrating a contact array located in a body of the electronic connector and the cable coupled to the contact array.

Referring now to the drawings, the present invention includes an electronic connector 10 configured to be coupled to a cable 12. The electronic connector 10 includes a plastic molded body 14 configured to receive a contact array 16. The contact array 16 is coupled to a common carrier strip 18 which is illustratively fabricated from a conductive alloy in a conventional manner. As best shown in FIGS. 1–3 , the contact array 16 is coupled to carrier 18 by three sections 20, 22 and 24. Adjacent contacts 26 are coupled together by a plurality of bridge sections 28. Contact array 16 includes U-shaped Insulation Displacement Contact ("IDC") sections 30 which are configured to receive signal conductors 32 of the cable 12 therein. Conductors 32 illustratively slide into the U-shaped openings of IDC sections 30 to provide electrical contact between the conductors 30 and selected contacts 26 within the array of contacts 16. Cable 12 also includes ground wires 34 best shown in FIGS. 6A–6E and discussed below.

The housing body 14 includes a plurality of openings 35 sized to receive the contacts 26. Body 14 mates with another connector (not shown) having contacts which enter opening 35 and engage contacts 26 of connector 10. The body 14 retains the array 16 in a predefined pattern. Barbs 36 of the array 16 are configured to engage or interfere with the portions of the body 14 when assembled together, thereby creating an interference coupling means. The interference provides the necessary retention so that the array 16 remains in its relative position within the body 14.

Figure 4D:
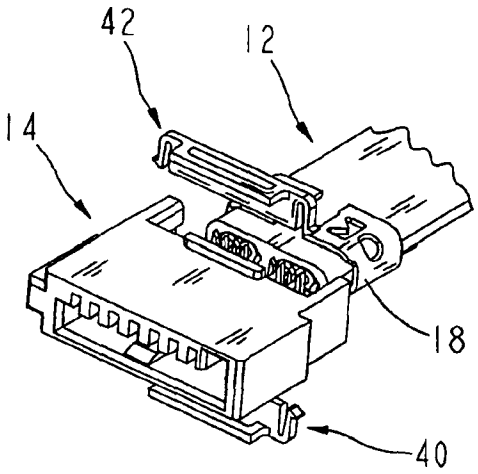
FIG. 4D is as perspective view of the apparatus of FIGS. 4A–4C.
Figure 4C:
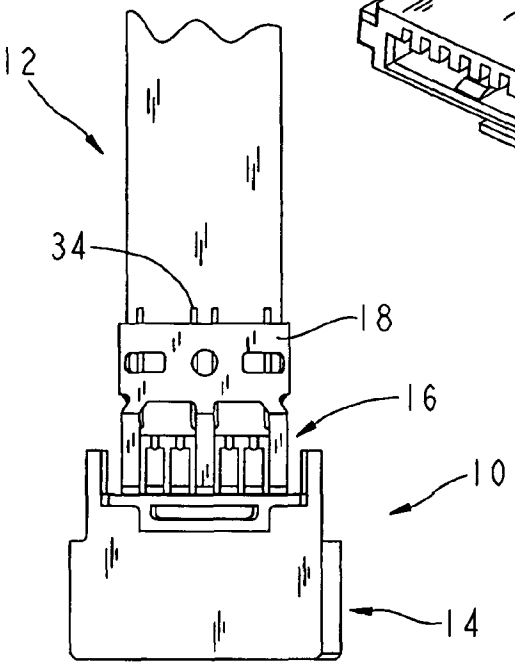
FIG. 4C is a bottom plan view of the apparatus of FIGS. 4A and 4B.
Figure 4B:
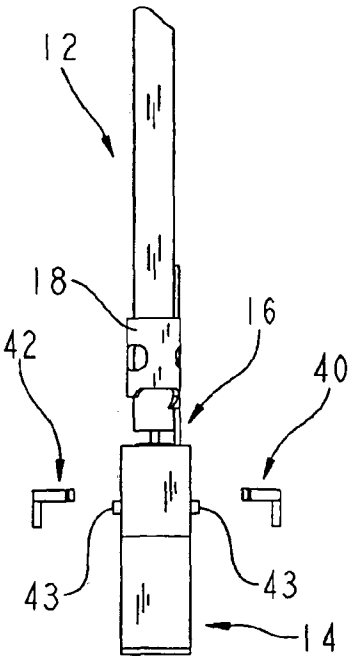
FIG. 4B is a side elevational view similar to FIG. 4A.
Figure 4A:
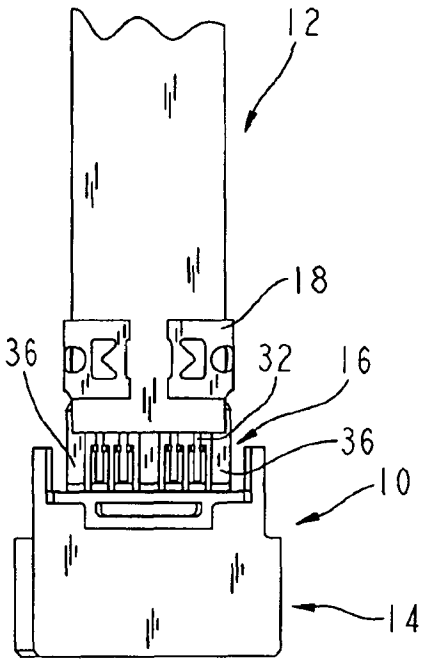
FIG. 4A is a top plan view similar to FIG. 3 illustrating a carrier strip wrapped around the cable to secure the contact array to the cable and provide grounding.
Figure 5B:
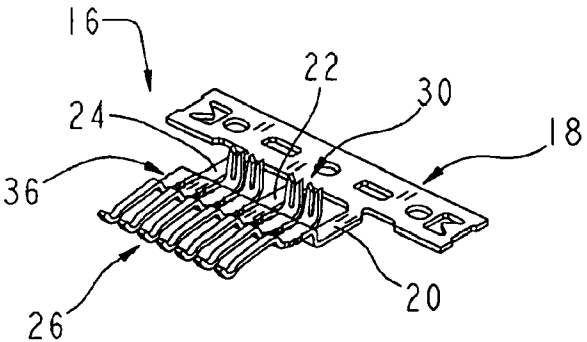
FIGS. 5A–5E disclose various configurations of an illustrative contact array of the present invention.
Figure 5E:
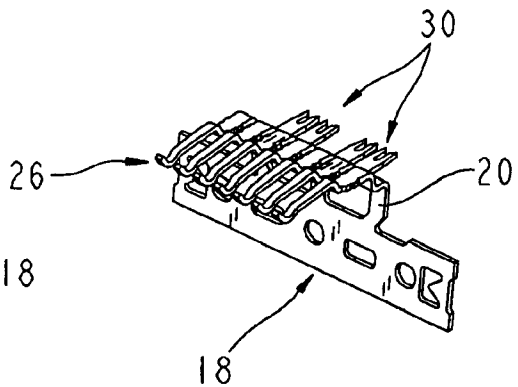
Figure 5D:
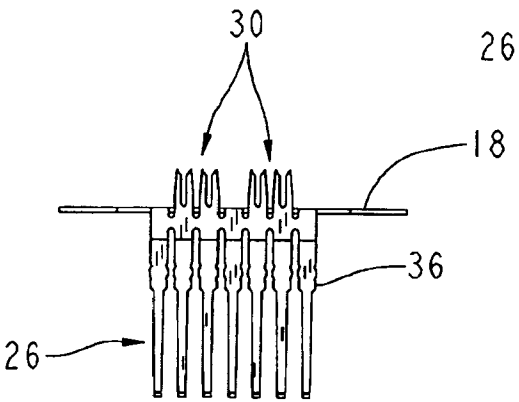
Figure 5A:
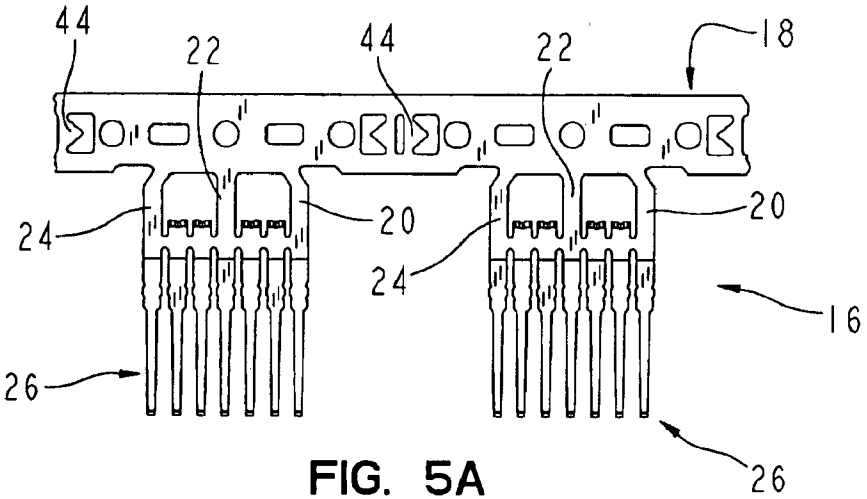
Figure 5C:
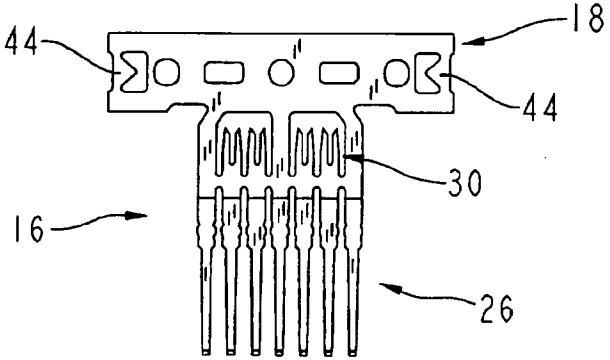
Figure 6D:
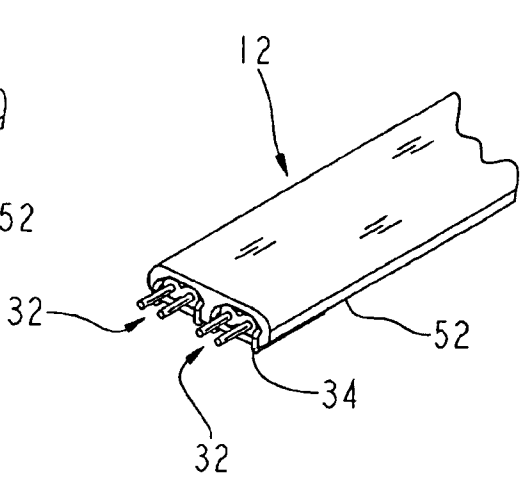
FIGS. 6A–6E disclose various configurations of an illustrative cable of the present invention.
Figure 6C:
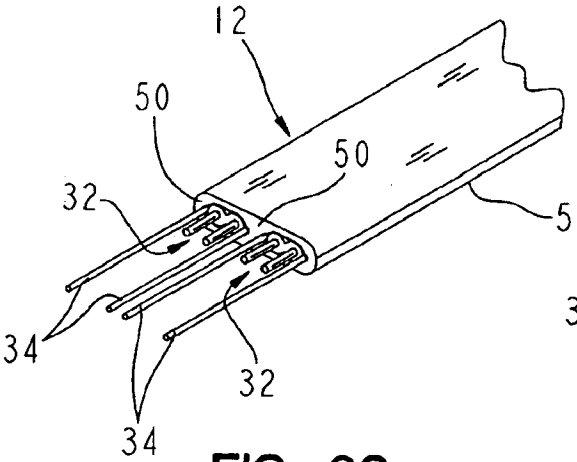
Figure 6A:
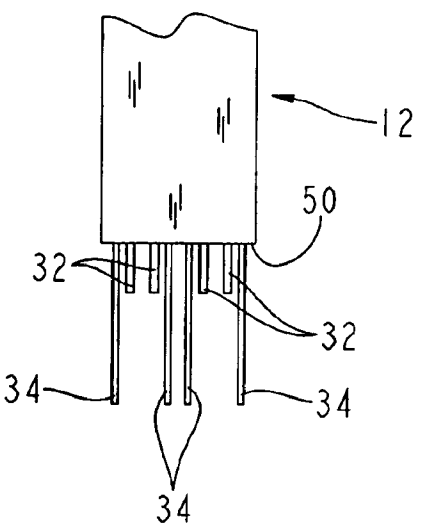
Figure 6E:
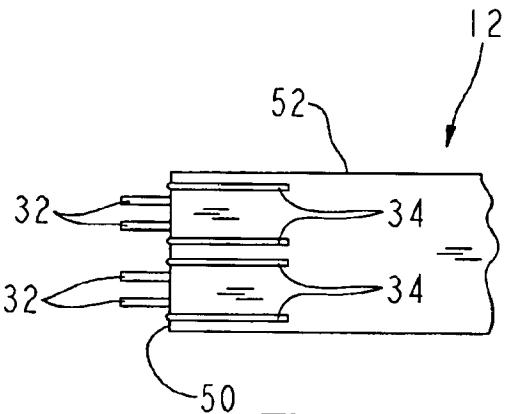
Figure 6B:
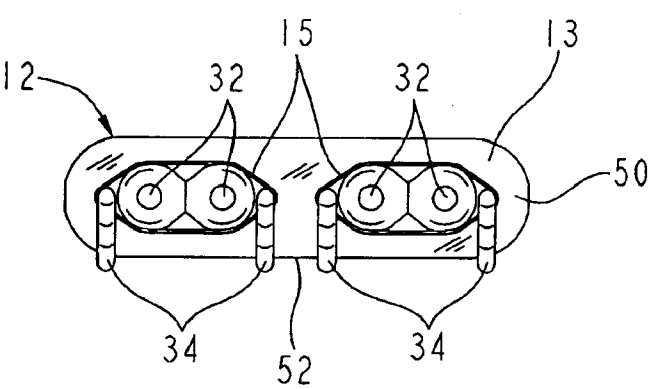

The array 16 comprises a plurality of adjacent contacts 26 that are attached to each other by means of bridges sections 28 as well as the carrier 18. Some of the contacts 26 of the array 16 incorporate an IDC section 30 that provides termination to a cable signal wires 32. The remaining contacts of the array 16 are attached to the carrier 18 by sections 20, 22, 24 shown in FIGS. 1 and 4C. The bridges 28 between each contact 26 are removed later in the manufacturing process making each contact 26 electrically discrete from an adjacent contact 26. [See FIGS. 4A and 4C]. Although the bridges 28 are removed the carrier 18 remains coupled to selected contacts 26 by sections 20, 22, 24. The contacts 26 that are attached to the carrier 18 create a common electrical interconnection called a 'bus'. This bus acts as the electrical grounding mechanism for the assembly. [See, for example, FIGS. 5A–5E]

An illustrative example of a cable 12 used to provide a serial ATA connection for the computer industry is best illustrated in FIGS. 6A–6E. As discussed above, the cable 12 illustratively includes four signal conductors 32, in two differential pairs. If necessary, the cable 12 may also include four ground drain wires 34 which are terminated to ground the contacts 26 of the electrical connector 10. It is understood that any cable that meets desired electrical requirements may be used in accordance with the present invention. In an illustrated embodiment, the drain wires 34 are formed or bent to extend downwardly along a front face 50 of cable 12 and under a bottom surface 52 of cable 12.

A stripped cable 12 with exposed signal wires 32 and drain wires 34 is then coupled to the array 16. The drain wires 34 are illustratively wrapped to the bottom surface 52 of the cable 12 [See FIGS. 6A–6C], so as to come into contact with the array carrier 18 when the carrier 18 is coupled to the cable 12. The signal wires 32 are terminated to the IDC contact sections 30 of the array 16. The carrier 18 is then formed and wrapped around the cable 12 as shown in FIGS. 4A–4D, and 7A, and 7B so that the carrier 18 engages the drain wires 34.

Figure 7B:
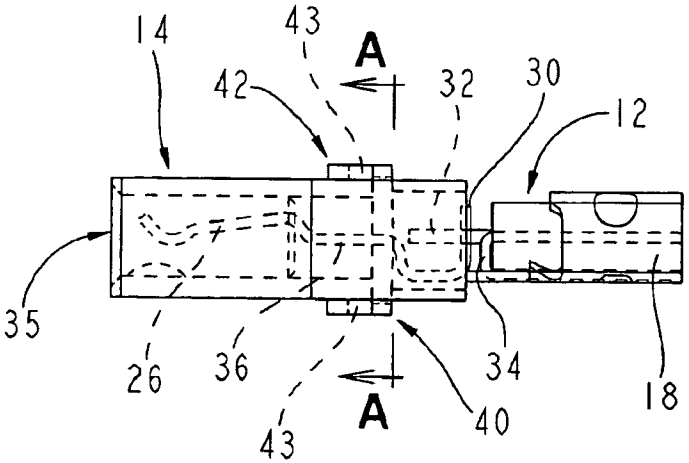
FIGS. 7A–7D disclose additional details of the electronic connector of the present invention.
Figure 7C:
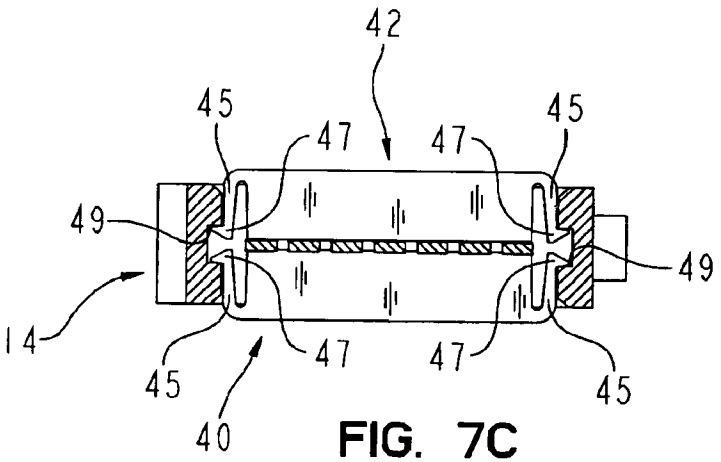
Figure 7A:
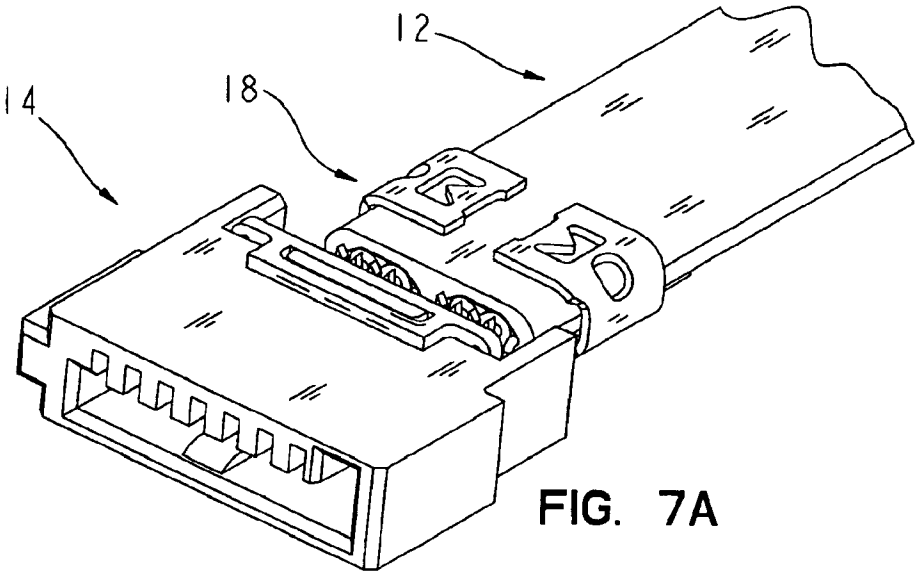
Figure 7D:
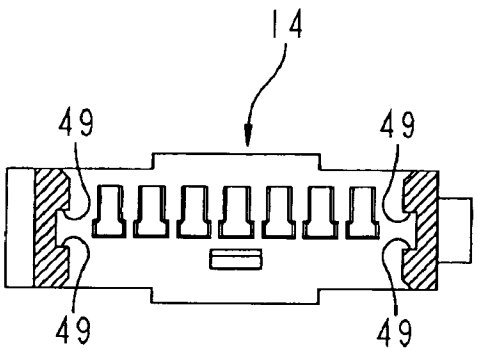

Two end caps 40, 42 are then clipped and locked into position at the base of the body 14, thereby creating a barrier preventing the flow of plastic into the intimate mating contact area (by means of the contact openings 35 at the base of the body 14) during an overmolding process. [See FIGS. 7A–7C] The end caps 40, 42 each include openings 41 which are located over tabs 43 on body 14. End caps 40, 42 also include spring arms 45 having heads 47 which engage internal flanges 49 of body 14 to secure the caps 40, 42 to the body 14 as best shown in FIG. 7C. Flanges 49 are best shown in FIG. 7D.

The method of terminating the drain wires 34 to the carrier 18 includes a forming and 'crimping' of the carrier 18 to the cable 12. Barb-shaped sections 44 [carrier piercers] are illustratively incorporated in the carrier 18. These sections 44 are pressed into the cable 12 so that the sections 44 pierce the jacket and create a retention mechanism to the table 12. These same barb-shaped sections 44 illustratively pierce through the jacket 13 and the ground shield 15 (see FIG. 6B) within the cable creating a redundant grounding scheme.

The present invention also allows for additional forms of drain wire termination if desired. The carrier 18 of the array 16 is illustratively heavily electroplated with tin/lead so that a metallic bond occurs between it and the drain wires 34 (also tin/lead plated) under compression. However, ultrasonic welding, laser welding, or heat reflow is still possible depending upon customer requirements.

In another embodiment of the present invention, a separate conductive strip is coupled to the cable 12, and then coupled to selected ground contacts 26 by a soldering process, or other suitable coupling method. In other words, conductive strip 18 is not a carrier for contacts 26 in this embodiment. In another embodiment, selected ground contacts 26 are integrally formed with a conductive strip such as strip 18, but the strip 18 is not a carrier strip used during formation of the contact array 16.

Illustrated features of the present invention include:

1. A conductive strip, such as an integral carrier 18, that creates a common grounding bus.

2. Carrier piercer sections 44 of the carrier 18 which act as retention members to the cable 12 as well as creating a redundant grounding mechanism.

3. Capping clips or end caps 40, 42 which are coupled to the connector body 14 to prevent overmolding plastic from entering the mating area of the connector 10.

4. Forming operation of the carrier 18 around the cable 12 provides a ground connection to the drain wires 34 as well as means for securing the array 16 to the cable 12.

Other devices assemble discrete contacts into the body and individually solder the cable wires to each contact. This process is very laborious, prone to error, and results in an electrically inferior product. Discrete soldering requires longer wire leads and longer wire leads results in degraded signal integrity.

Without the use of the end caps 40, 42, an epoxy must be used to seal the end of the body 14 to prevent the overmold material from entering into the intimate mating area of the connector. The epoxy process is laborious and time consuming.

In order to prevent stress and strain to the solder joints of conventional cable wires are wrapped with a textured tape. The overmold plastic adheres to the textured tape so that any forces exerted on the cable will be transmitted to the overmold instead of the solder joints. The taping process is laborious, costly, and often falls short of a true strain relief.

In some configurations a pair of cable drain wires must be twisted together and soldered to one contact. The common carrier/ground bus of the present invention does not require this.

The carrier array 16 with IDC sections 30 that engage conductors 32 eliminates the need to hand-solder discrete cable wires to the contacts. The capping clips 40, 42 seal an end of the body 14 prevent to the flow of injected overmold material into the intimate mating area of the connector 10.

The wrapped carrier 18 acts as a strain relief for connector 10. The overmold plastic material adheres to the carrier and its features as well as to the body and its features thereby creating a bond between them. Therefore, forces from the cable 12 are not transmitted to the contacts 16. The common carrier/ground bus 18 of the present invention does not require twisting of wires.

Although the invention has been described in detail with reference to a certain illustrated embodiments, variations and modifications exist within the scope and spirit of the invention as described and as defined in the following claims.

What is claimed is:

1. An electronic connector apparatus for a cable having a plurality of signal conductors and a ground, the apparatus comprising:

an insulative body including a plurality of contact-receiving openings formed therein; and a contact array including a carrier strip and a plurality of contacts coupled to the carrier strip, the plurality of contacts being located in the plurality of contact-receiving openings of the body, selected ones of the plurality of contacts being coupled to the signal conductors of the cable, and the carrier strip being coupled to an end portion of the cable in contact with the ground of the cable to provide a ground connection between the cable ground and at least one of the plurality of contacts; and at least one end cap coupled to the body to prevent plastic from entering a mating area of the body during an overmolding process.

2. The apparatus of claim 1, further comprising means for securing the carrier strip to the cable.

3. The apparatus of claim 1, wherein the carrier strip includes at least one retention section that is configured to pierce the end portion of the cable to couple the carrier strip and the contact array to the cable.

4. The apparatus of claim 3, wherein the retention section is electrically coupled to a ground shield located within the cable.

5. The apparatus of claim 1, wherein the at least one end cap includes at least one spring arm to couple the at least one end cap to the body.

6. The apparatus of claim 1, wherein the contact array includes a plurality of couplers configured to couple the selected contacts to the signal conductors of the cable electrically, without the use of solder.

7. The apparatus of claim 6, wherein the plurality of couplers are insulation displacement contact sections.

8. The apparatus of claim 1, wherein the cable ground includes at least one drain wire extending from the end portion of the cable, the carrier strip being coupled to the end portion of the cable in contact with the at least one drain wire to provide a ground connection between the at least one drain wire and at least one of the plurality of contacts.

9. A method for coupling an electric connector to a cable having a plurality of signal conductors, an insulative jacket and a ground, the method comprising:

providing an insulative body including a plurality of contact-receiving openings formed therein;

providing a contact array including a carrier strip and a plurality, of contacts, the carrier strip being used to support the plurality of contacts during a forming process;

inserting the plurality of contacts into the contact-receiving openings of the body;

coupling the carrier strip to an end portion of the cable; and separating selected ones of the plurality of contacts from the carrier strip; wherein the step of coupling the carrier strip to an end portion of the cable includes wrapping the carrier strip around the insulative jacket of the cable.

10. The method of claim 9, further comprising coupling selected ones of the plurality of contacts to the signal conductors of the cable.

11. The method of claim 9, further comprising coupling the carrier strip to the ground of the cable to provide a ground connection between cable ground and at least one of the plurality of contacts.

12. The method of claim 9, wherein the carrier strip includes at least one retention section which is configured to pierce the end portion of the cable to couple the carrier strip and the contact array to the cable.

13. The apparatus of claim 12, wherein the retention section is electrically coupled to a ground shield located within the cable.

14. The method of claim 9, further comprising aching at least one end cap to the body to prevent plastic from entering a mating area of the body, and overmolding portions of the body, the carrier, and the cable.

15. The method of claim 9, wherein the cable ground includes at least one drain wire extending from the end portion of the cable, the carrier strip being coupled to the end portion of the cable in contact with the at least one drain wire to provide a ground connection between the at least one drain wire and at least one of the plurality of contacts.

16. The method of claim 9, wherein the cable ground includes at least one drain wire extending from the end portion of the cable, the carrier strip being located over and engaging the at least one drain wire to provide a ground connection between the at least one drain wire and at least one of the plurality of contacts.

17. An electronic connector apparatus for a cable including an insulative jacket having an outer surface, a plurality of signal conductors and a cable ground, the apparatus comprising:

an insulative body including a plurality of contact-receiving openings formed therein;

a conductive strip engaged with the insulative jacket of the cable in contact with the cable ground, the conductive strip having a retention section to secure the conductive strip to the jacket; and a plurality of contacts located in the plurality of contact-receiving openings of the body, the plurality of contacts including a plurality of signal contacts coupled to the signal conductors of the cable, and at least one ground contact formed integrally with the conductive strip to provide a ground connection between the cable ground and the at least one ground contact through the conductive strip.

18. The apparatus of claim 17, wherein the at least one ground contact is a separate piece from the conductive strip.

19. The apparatus of claim 17, wherein the at least one ground contact is formed integrally with the conductive strip.

20. The apparatus of claim 17, further comprising means for securing the conductive strip to the cable.

21. The apparatus of claim 17, wherein the conductive strip includes at least one retention section that is configured to pierce the jacket of the cable to couple the conductive strip and the at least one ground contact to the cable.

22. The apparatus of claim 21, wherein the retention section is electrically coupled to a ground shield located within the cable.

23. The apparatus of claim 17, further comprising at least one end cap coupled to the body to prevent plastic from entering a mating area of the body during an overmolding process.

24. The apparatus of claim 23, wherein the at least one end cap includes at least one spring arm to couple the at least one end cap to the body.

25. The apparatus of claim 17, wherein the plurality of signal contacts each include a coupler configured to couple the signal contact to a signal conductor of the cable electrically, without the use of solder.

26. The apparatus of claim 25, wherein the coupler are insulation displacement contact sections.

27. The apparatus of claim 17, wherein the cable ground includes at least one drain wire extending from an end portion of the cable, the conductive strip being coupled to the jacket of the cable in contact with the at least one drain wire to provide a ground connection between the at least one drain wire and the at least one ground contact.

28. The apparatus of claim 17, wherein the conductor strip is a carrier strip for use in forming the plurality of contacts.

29. The method of installing the connector apparatus of claim 17 on the cable.

30. An electronic connector apparatus comprising:

a cable including an insulative jacket having an outer surface, a plurality of signal wires, and at least one a drain wire positioned over the outer surface of the jacket;

an insulative body including a plurality of contact-receiving openings formed therein;

a conductive strip positioned over the outer surface of the jacket of the cable in contact with the at least one drain wire, the conductive strip having a retention section to secure the conductive strip to the jacket; and a plurality of contacts located in the plurality of contact-receiving openings of the body, the plurality of contacts including a plurality of signal contacts coupled to the signal wires of the cable, and at least one ground contact formed integrally with the conductive strip to provide a ground connection between the at least one drain wire and the at east one ground contact through the conductive strip.

31. The apparatus of claim 30, wherein the at least one ground contact is a separate piece from the conductive strip.

32. The apparatus of claim 30, wherein the at least one ground contact is formed integrally with the conductive strip.

33. The apparatus of claim 30, wherein the retention section is configured to pierce the jacket of the cable to couple the conductive strip and the at least one ground contact to the cable.

34. The apparatus of claim 33, wherein the retention section is electrically coupled to a ground shield located within the cable.

35. The apparatus of claim 30, wherein the plurality of signal contacts each include a coupler configured to couple the signal contact to a signal wire of the cable electrically, without the use of solder.

36. The apparatus of claim 30, wherein the conductive strip is a carrier strip for use in forming the plurality of contacts.

* * * * *